US006864448B2

(12) United States Patent
Pozgay et al.

(10) Patent No.: US 6,864,448 B2
(45) Date of Patent: Mar. 8, 2005

(54) POWER HAND TOOL HAVING A SLIDE SWITCH ASSEMBLY WITH A DYNAMIC SEAL

(75) Inventors: David Pozgay, Evanston, IL (US); Steven Holzer, Chicago, IL (US)

(73) Assignee: Credo Technology Corporation, Broadview, IL (US)

( * ) Notice: Subject to any disclaimer, the term of this patent is extended or adjusted under 35 U.S.C. 154(b) by 0 days.

(21) Appl. No.: 10/437,596

(22) Filed: May 14, 2003

(65) Prior Publication Data

US 2004/0226809 A1 Nov. 18, 2004

(51) Int. Cl.[7] ..... H01H 9/06
(52) U.S. Cl. ..... 200/322.2; 200/522
(58) Field of Search ..... 200/332, 334, 200/341, 552, 509, 533, 539, 547–549, 302.1, 302.2, 302.3, 573, 550, 522, 322.2

(56) References Cited

U.S. PATENT DOCUMENTS 4,027,127 A * 5/1977 Dummer ..... 200/522
4,271,342 A * 6/1981 Sistare ..... 200/332.2
4,324,956 A 4/1982 Sakakino et al.
4,328,405 A * 5/1982 Cuneo ..... 200/522
4,698,471 A * 10/1987 Piber ..... 200/302.2
4,742,199 A 5/1988 Andis et al.
4,839,483 A 6/1989 Doyle
5,428,197 A * 6/1995 McCurry et al. ..... 200/332.3
5,510,589 A * 4/1996 Arnal ..... 200/522
5,575,380 A 11/1996 Imai
6,008,458 A * 12/1999 Domzalski et al. ..... 200/302.1
6,313,420 B1 11/2001 Ohashi
6,376,790 B1 4/2002 Kawase

* cited by examiner

*Primary Examiner*—Elvin Enad
*Assistant Examiner*—Lisa Klaus
(74) *Attorney, Agent, or Firm*—Greer, Burns & Crain, Ltd

(57) ABSTRACT

A switch assembly for use with a power tool that includes an enclosure with an open top, a switch body with multiple switch contacts, with the switch body being located in the enclosure and having connectors for connecting to electrical conductors that selectively extend to the motor and the power source. The switch assembly further includes a slide switch mechanism for selectively engaging certain ones of the switch contacts for determining the operating characteristics of the motor, an actuating switch cover operatively connected to the slide switch mechanism, wherein the cover is slideable between at least two operating positions, with the switch cover being operatively accessible by a user, and a compressible seal positioned between the actuating switch cover and the switch body, with the seal extending around substantially the entire circumference of the top of the switch body.

6 Claims, 4 Drawing Sheets

POWER HAND TOOL HAVING A SLIDE SWITCH ASSEMBLY WITH A DYNAMIC SEAL

BACKGROUND OF THE INVENTION

The present invention generally relates to power hand tools and more particularly to a switch assembly of the type used with power hand tools to prevent contamination of power hand tool switch assembly components.

There has been continued innovation and improvement in the design of power hand tools of the type that are used in cutting drywall. Examples of such products are those sold under the Bosch brand produced by the Robert Bosch Tool Corporation. These power hand tools have a generally cylindrically shaped housing to which a removable handle can be attached, with the housing containing a drive motor having a rotary output shaft to which a side cutting bit can be attached. When cutting drywall, there is usually a significant amount of dust that is produced and tends to coat the unit. To selectively control the motor, such power hand tools are further provided with an electrical switch assembly that typically has multiple operating positions for operating the tool at different speeds.

While such switch assemblies in the form of slide-type switch operation have been available for many years, a recurring and persistent problem has been dust contamination of the switch assembly components, which can eventually result in switch assembly failure. While it is possible to purchase elaborately constructed switch assemblies that are tightly sealed so that dust cannot enter the switch components of the assembly, such sophisticated switch assemblies are significantly more expensive than the slide-type switches that are currently in commercial use.

SUMMARY OF THE INVENTION

The present invention is related to a power hand tool having a slide switch assembly that is particularly effective in preventing contamination of switch assembly components during operation of the power hand tool. A preferred embodiment of the present invention comprises a switch assembly of generally conventional construction, but which is modified to include a seal configured and arranged to prevent entry of dust and other ambient debris into the slide switch assembly components during operation of the power hand tool.

DETAILED DESCRIPTION OF THE INVENTION

Figure 1:
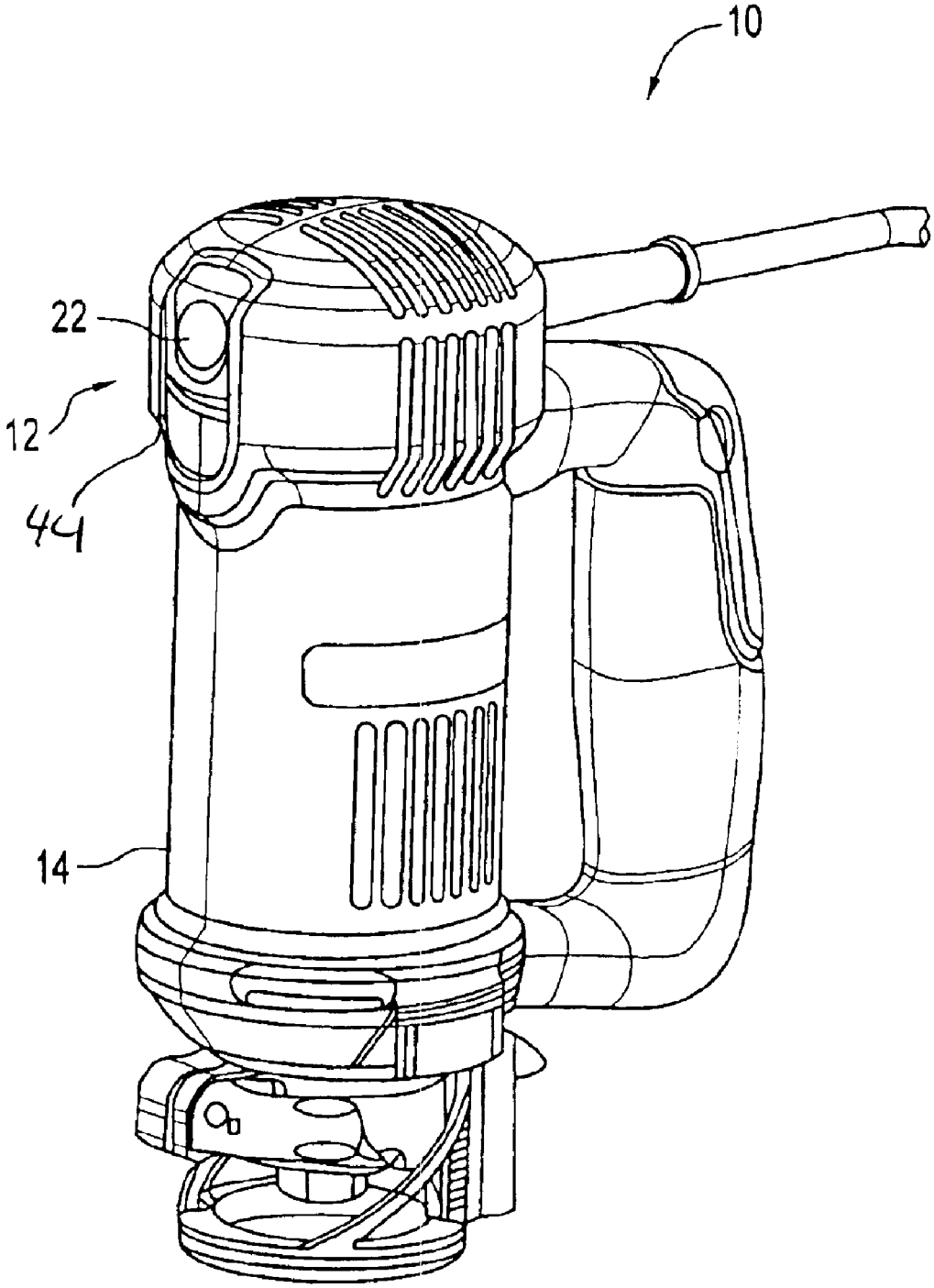
FIG. 1 is a perspective view of the rotary hand tool having a slide switch assembly embodying the present invention.
Figure 2:
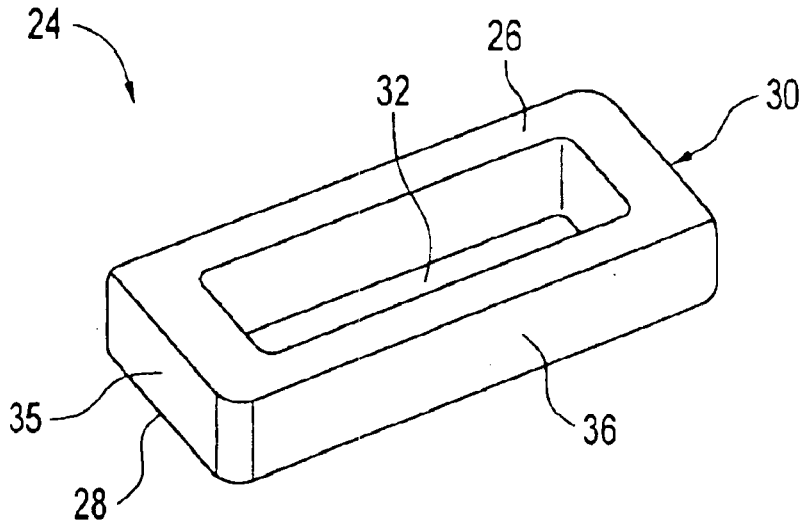
FIG. 2 is a perspective view of the seal that is used in the embodiment shown in FIG. 1.

Typically, a switch assembly of the type used in a drywall cutting power hand tool includes a switch cover having a slide switch mechanism that reciprocates within a stationary slide switch body to effectuate multiple operating positions. For example, a first position may de-energize the tool, while second and third positions may cause tool operation at different speeds. To actuate a drywall cutout rotary tool, a user exerts force upon the switch cover in a direction parallel to a longitudinal axis of the tool. The slide switch mechanism is disposed on an underside of the switch cover, and therefore reciprocates as the switch cover is moved. The switch body includes multiple switch contacts, and is located within an enclosure of the slide switch assembly, as are connectors for connecting to electrical conductors that selectively extend to the motor and the power source.

In the absence of the seal disclosed by the instant application, the slide switch mechanism directly contacts and operatively engages the slide switch body of the switch assembly, thereby lacking an effective seal to prevent entry of drywall dust and other contaminants. Because the switch cover and the enclosure are not sufficiently sealed to one another in the absence of a seal, contaminants may enter the switch assembly at the unsealed interface of the two components.

The preferred embodiment of the power hand tool, designated generally at 10, operates in association with a slide switch assembly 12. In addition to the slide switch assembly 12, the power hand tool 10 includes a housing 14, while the slide switch assembly typically includes an enclosure 16, a slide switch body 18 having multiple switch contacts (not shown), a slide switch mechanism 20, an actuating switch cover 22, and a seal 24. Optionally, the slide switch assembly 12 may be specifically modified to accommodate the seal 24. More specifically, the instant seal 4024 is configured and arranged to have a top surface 26 and a bottom surface 28 that respectively engage the switch cover 22 and the slide switch body 18, and includes a seal body 30 having a generally rectangular circumference and a generally rectangular opening 32 extending through a central portion thereof, wherein both the generally rectangular circumference and the generally rectangular opening preferably include radiused corners.

Figure 5:
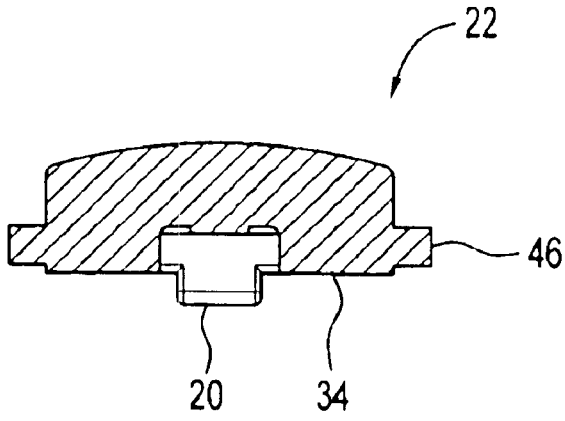
FIG. 5 is a front elevational view of the switch cover that is used in the embodiment shown in FIG. 1.
Figure 3:
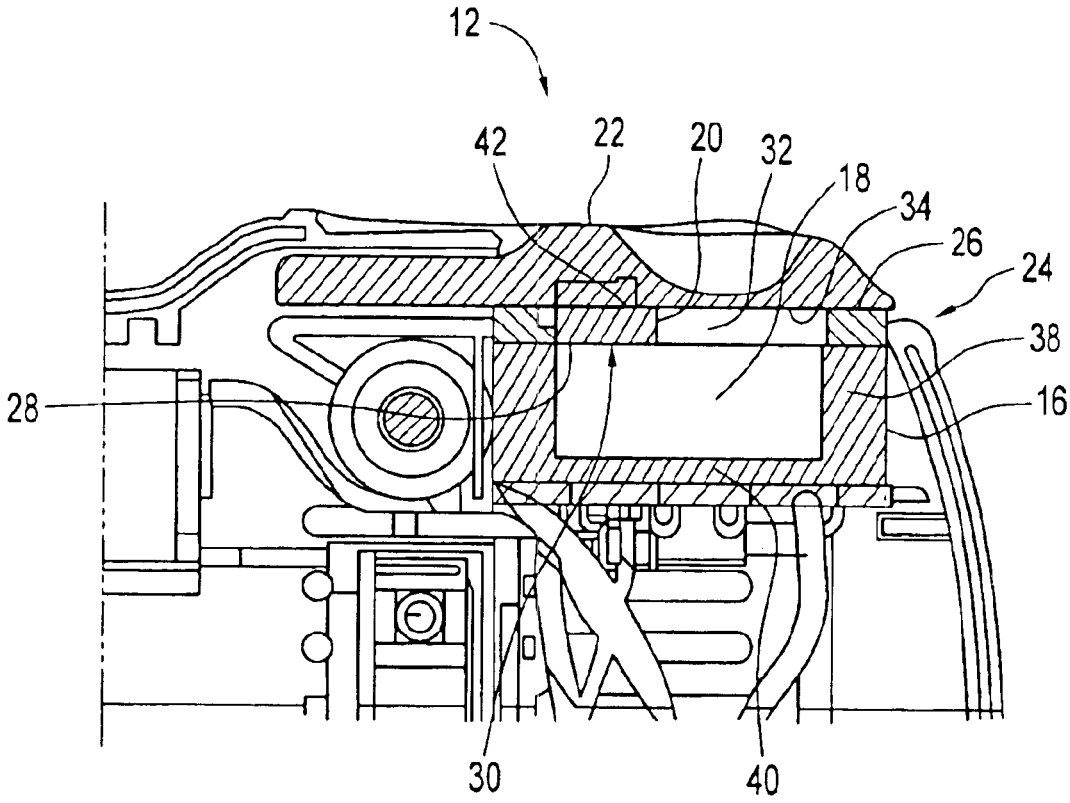
FIG. 3 is side cross-sectional view of a portion of the embodiment shown in FIG. 1.

The slide switch mechanism 20 (best shown in FIG. 5) is disposed on an underside 34 of the switch cover 22, and the generally rectangular opening 32 is configured and arranged to accommodate the slide switch mechanism, allowing reciprocation of the switch cover along a longitudinal axis of the generally rectangular opening. The slide switch mechanism 20 depends from the switch cover 22 and extends into the generally rectangular opening 32 to engage a switch lever (not shown) that extends into the generally rectangular opening. Thus, the top surface 26 of the seal 24 is configured to engage the switch cover 22, while the bottom surface 28 of the seal is configured to engage the slide switch body 18, thereby promoting engagement of the seal with both the switch cover and the switch body. The switch lever is actuated when the switch cover 22, which is operably connected to the switch lever via the slide switch mechanism 20, is reciprocated.

While the instant seal 24 is suitable for use with a variety of switch assemblies of the type used with power hand tools, for purposes of illustration, the seal operating in connection with a slide switch assembly 12 of a drywall cutout rotary tool 14 will be shown and described. Such slide switch assemblies 12 typically operate using linear reciprocation of the slide switch mechanism 20 along a predetermined track having multiple operating positions along a length thereof.

Accordingly, the seal of the instant invention is configured and arranged to engage both the switch cover 22 and the slide switch body 18, enhancing a seal between the switch cover and the slide switch body while also providing an additional mechanical barrier to ambient debris.

As disclosed, the preferred seal 4024 has a generally rectangular body, preferably with radiused corners. Similarly, the central opening 32 disposed therethrough is generally rectangular, and preferably includes radiused corners. While the instant invention contemplates incorporation of corners having a shape other than radiused, such as square corners, radiused corners impart a flexibility to the seal 24 that prevents tearing of the seal during operation. Thus, the seal body 30 is configured to have a generally hollow, rectangular, ring shape, with a predetermined lateral wall thickness defined at its interior by an inner circumference of the opening 32 and at its exterior by an outer circumferential wall. Preferably, end walls 35 are slightly thicker than side walls 36. The predetermined wall thickness may vary to suit individual applications, but is preferably between 4.4 mm and 5.0 mm for the end walls 35, and between 3.5 and 4.1 for the side walls 36. Additionally, the seal body 30 has a predetermined height, preferably between 4.3 mm and 5.2 mm.

Correspondingly, the enclosure 16 of the slide switch assembly 12 has outer walls 38 of a predetermined thickness, a bottom wall 40 of a predetermined thickness, and a generally rectangular open top portion 42. The seal 24 is generally configured so that the dimensions of the predetermined wall thickness of the seal body 30 are coextensive with the outer walls 38 of the enclosure 16 so that the seal may be disposed on a top surface of the enclosure. Moreover, the bottom surface 28 of the seal 24 is preferably provided with adhesive properties so that the seal firmly adheres to the enclosure 16, and remains stationary with the enclosure while the switch cover 22 reciprocates with respect to both the stationary seal and the enclosure to which it adheres. The instant invention contemplates use of any suitable adhesive sufficient to maintain engagement between the stationary seal 24 and the enclosure 16, preferably a material such as a film-supported tape. For example, one preferable film-supported tape is manufactured by Adchem Corporation of Riverhead, N.Y. under the brand name Adchem® 256-M.

While the dimensions of the seal 424 may vary to suit individual slide switch assembly 12 dimensions, the preferred embodiment includes a seal having a longitudinal length of between approximately 30.05 mm and 30.85 mm and a width of between approximately 13.6 mm and 14.4 mm. More specifically, the instant seal 24 includes the seal body 30 having wall thicknesses as previously described, while the length and width of the central opening 32 preferably measure 21.05 mm and 6.4 mm respectively.

To enhance its sealing properties, the preferred seal 24 includes a compressible, elastic material, such as a cellular urethane having an open celled structure; such as Poron®, manufactured by the Rogers Corporation of Rogers, Conn. Ideally the composite material of the seal 24 has a hardness sufficient to withstand cycling but that is soft enough so that actuation of the slide switch assembly 12 is not inhibited. When compressed, the slide switch assembly 12, which includes the compressible seal 24 compresses from between 20% to 40%, preferably about 20%. Because the seal 24 preferably includes a compressible material, the underside 30 of the switch cover 22 is preferably smooth to reduce friction between the switch coyer and the seal as the switch cover reciprocates and to promote slideability of the switch cover atop the seal.

Figure 4:
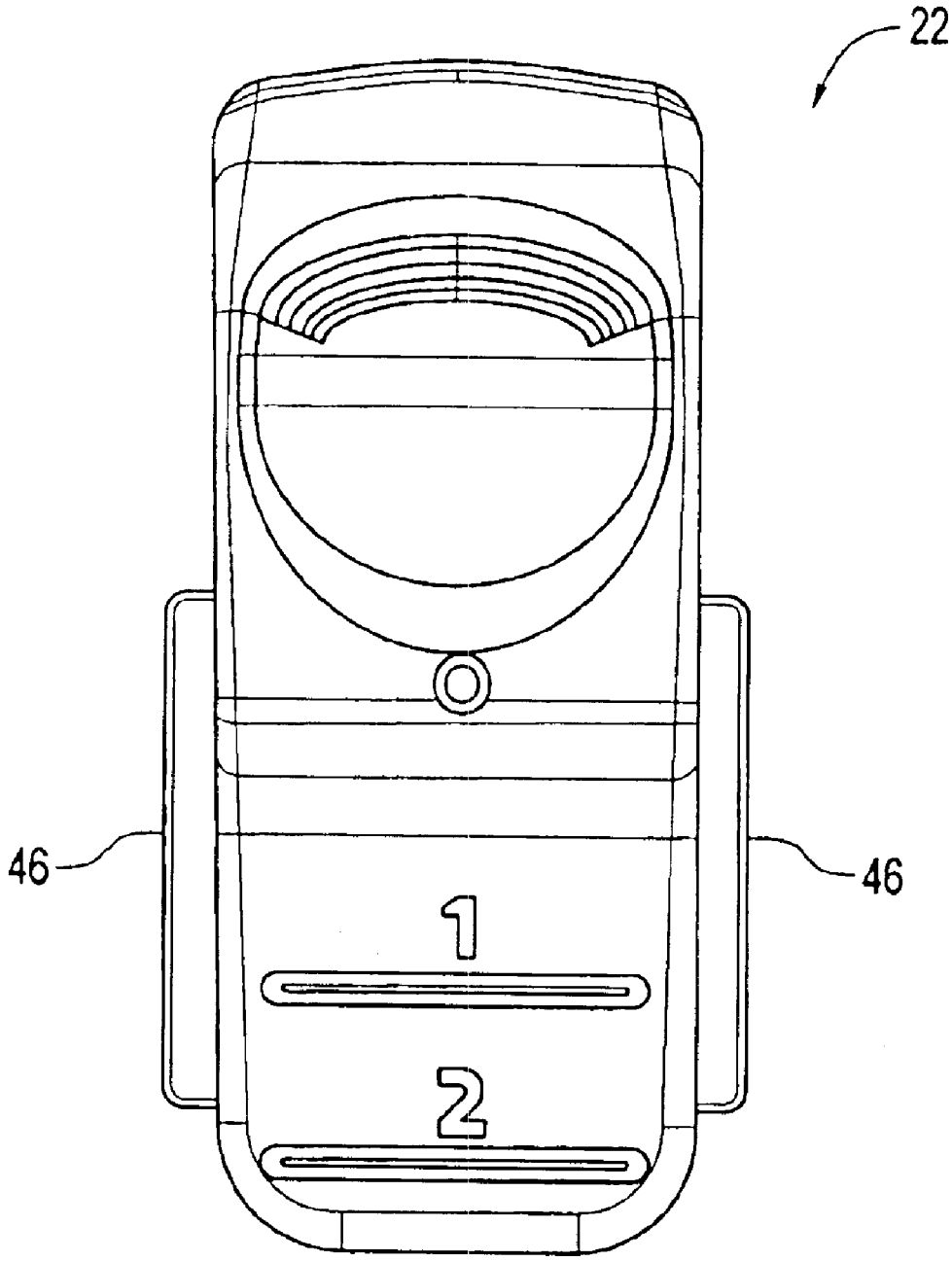
FIG. 4 is a top view of the switch cover that is used in the embodiment shown in FIG. 1.

In a typical slide switch, a slide cover reciprocates within a predetermined track. To promote adequate compression of the compressible seal 24, which imparts sealing properties to the slide switch assembly 12, a predetermined pair of tracks 44 is configured and arranged so that when the slide switch cover 22 is matingly engaged therewith, the preferred compression percentages will be achieved. To this end, the housing 14 preferably includes the pair of elongated tracks 44, into which side flanges 46 (best shown in FIG. 4) of the switch cover 22 matingly engage. The side flanges 46 reciprocate within the respective on of the pair of elongated tracks 44, which are situated at a predetermined height above the seal 24 so that when engaged with the elongated tracks, the side flanges 46 compress the seal 24 at a predetermined percentage, such as 20%.

To further promote the sealing properties of the instant seal 24, the slide switch assembly 12 in which the seal operates may be modified to specifically accommodate the dimensions of the seal. For example, in a conventional slide switch assembly, the underside 32 of the switch cover 22 directly contacts the enclosure 16. Thus, to accommodate the seal 24 without altering the overall dimensions of the slide switch assembly 12, the switch cover 22 may optionally be modified to accommodate the height of the seal 24. For example, the height of the switch cover 22 may be reduced by an amount corresponding to the height of the seal 24.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A power hand tool having an output shaft and means for attaching a working tool for engaging a work portion for performing a work operation thereon, the hand tool comprising:

a housing having a motor adapted to be driven by a power source, said motor driving the output shaft during operation;

an electrical switch assembly in said housing operatively connected to control the ehergization of the motor;

said switch assembly further comprising:

an enclosure with an open top;

a switch body with multiple switch contacts, said switch body being located in said enclosure and having connectors for connecting to electrical conductors that selectively extend to said motor and the power source;

a slide switch mechanism for selectively engaging certain ones of said switch contacts for determining the operating characteristics of said motor;

an actuating switch cover operatively connected to said slide switch mechanism, said actuating switch cover being slideable between at least two operating positions, said actuating switch cover being operatively accessible by a user;

a compressible seal positioned between said actuating switch cover and said switch body, said compressible seal extending around substantially the entire circumference of a top of the switch body.

2. A power hand tool as defined in claim 1 wherein said operating positions include a first position where said motor is de-energized and a second position where said motor runs at a first speed.

3. A power hand tool as defined in claim 1 wherein said operating positions include a third position where said motor runs at a second speed.

4. A power hand tool as defined in claim 1 wherein said enclosure has outer walls of a predetermined thickness and the shape of the open top of the enclosure is generally rectangular, said seal being in the shape of a hollow rectangle with a width that is generally coextensive with the width of said enclosure wall thickness.

5. A power hand tool as defined in claim 1 wherein said seal is made of a compressible polymeric material.

6. A power hand tool as defined in claim 5 wherein said seal has an adhesive on the surface contacting said switch cover for adhering the seal to said switch body.

* * * * *

UNITED STATES PATENT AND TRADEMARK OFFICE

CERTIFICATE OF CORRECTION

PATENT NO. : 6,864,448 B2
DATED : March 8, 2005
INVENTOR(S) : Pozgay et al.

It is certified that error appears in the above-identified patent and that said Letters Patent is hereby corrected as shown below:

Column 2,
Line 35, delete “4024” and insert -- 24 --.

Column 3,
Line 10, delete “4024” and insert -- 24 --.
Line 54, delete “424” and insert -- 24 --.

Column 4,
Line 63, delete “ehergization” and insert -- energization --.

Signed and Sealed this

Twenty-third Day of August, 2005

JON W. DUDAS
*Director of the United States Patent and Trademark Office*